US005489368A

United States Patent [19]

Suitsu et al.

[11] Patent Number: 5,489,368

[45] Date of Patent: Feb. 6, 1996

[54] INSOLUBLE ELECTRODE STRUCTURAL MATERIAL

[75] Inventors: Akihiro Suitsu; Ryuji Hayashi; Kenichi Ozaki, all of Kanagawa; Takayuki Shimamune, Tokyo, all of Japan

[73] Assignee: Permelec Electrode, Ltd., Kanagawa, Japan

[21] Appl. No.: 274,355

[22] Filed: Jul. 13, 1994

Related U.S. Application Data

[63] Continuation of Ser. No. 9,977, Jan. 27, 1993, abandoned.

[30] Foreign Application Priority Data

Jan. 28, 1992 [JP] Japan ..... 4-013427

[51] Int. Cl.[6] ..... C25D 17/12

[52] U.S. Cl. ..... 204/290 R; 204/280

[58] Field of Search ..... 204/212, 280, 204/290 F, 286, 297 R, 272, 290 R; 205/143, 137

[56] References Cited

U.S. PATENT DOCUMENTS 4,318,794 3/1982 Adler ..... 204/216
4,956,053 9/1990 Polan et al. ..... 204/13

FOREIGN PATENT DOCUMENTS 0336071 10/1989 European Pat. Off. .

OTHER PUBLICATIONS

Patent Abstracts of Japan vol. 13, No. 457 (C–644)(3805) 16 Oct. 1989 and JP–A–11 76 100 (NKK Corp.) 12 Jul. 1989 no month available.

*Primary Examiner*—Kathryn Gorgos
*Attorney, Agent, or Firm*—Sughrue, Mion, Zinn, Macpeak & Seas

[57] ABSTRACT

An insoluble electrode structural material comprising a tabular or curved electrode base plate having at least one thin plate-form insoluble metal electrode detachably fixed to at least a part of the surface of the base plate.

1 Claim, 1 Drawing Sheet

INSOLUBLE ELECTRODE STRUCTURAL MATERIAL

This is a Continuation of application Ser. No. 08/009,977 filed Jan. 27, 1993, now abandoned.

FIELD OF THE INVENTION

The present invention relates to an insoluble electrode structural material which is used for a high-speed continuous plating apparatus and a metal foil continuous electrolytically producing apparatus.

BACKGROUND OF THE INVENTION

In a continuous high-speed electric plating apparatus such as a zinc plating apparatus and a tin plating apparatus for steel plates, an insoluble lead electrode and a insoluble lead alloy electrode have been used in the past. In these types of apparatus, the effective electrode area of the electrode is very large, for example from 1 to 3 $m^2$.

Also, in a metal foil continuous electrolytically producing apparatus such as a copper foil electrolytic producing apparatus, a lead alloy electrode has been used for a long time as an anode facing cylindrical cathod. The anode surrounds ¼ of the circumference of the cylindrical cathod having a diameter of 3 meters and a width of from 1.5 to 2 meters and the size of the anode is from 3.5 to 4 $m^2$. A lead alloy electode has a low melting point and can be easily worked. Even when the size of the anode is large, the anode can be easily welded and the form can be easily adjusted at a place where a metal foil producing apparatus is disposed. Thus, problems in working the electrode are relatively low.

However, since it is difficult to uniformly solidify a molten electrode material for forming a large electrode and in particular, it is impossible to uniformly solidfy the molten electrode material at the location where an electrolytic apparatus is disposed, it is difficult to obtain a uniform alloy composition at the active portion of the electrode. As a result, it is actually impossible to provide the electrode surface with a uniform electrode potential.

That is, the oxygen generating potential of the lead alloy electrode in sulfuric acid deviates from 1.8 volts to 2.2 volts to NHE at 60° C. and 20 $A/dm^2$, and also a lead-silver alloy electrode having an excellent corrosion resistance usually deviates from 100 mV to 200 mV with a slight difference in silver content.

Accordingly, the electrode which is used for the purpose of passing an electric current as a counter electrode to a cathode which is a working electrode is easily usable but even the electrode has a large disadvantage for obtaining a high accuracy as the elecrode for an electric plating apparatus or a metal foil producing apparatus which must have passing electric current uniformity.

Also, since the consumption of these insoluble elecrodes on electrolysis is very large as several mg/Ah and the change in the form of the electrode surface is large, there is a problem that maintenance must be frequently carried out for correction and there are problems that lead to contamination of the electrolyte by consumed components which are intermixed in the products as metallic lead, lead ions, lead sulfate, and/or lead oxide. This reduces the quality of the products and also causes environmental pollution if the waste solution is not treated.

Thus, for solving these problems, recently, an insoluble metal elecrtode formed by coating the surface of a rare metal such as titanium with an electrically conductive electrode material such as a platinum group metal has been used.

A platinum-plated titanium electrode has been used as an insoluble metal electrode for a long time. The consumption of platinum is from several mg/kAh to several tens of mg/kAh, which is far less than that of a lead alloy. However, the consumed amount of the electrode is larger than that of a platinum-plated titanium electrode which is used for a general electrolysis of an aqueous solution. Thus, there is a problem that the electrode with a platinum coating of an ordinary thickness of from 3 to 5 μm, i.e., having a platinum coated amount of from 60 to 100 $g/m^2$, has a very short electrode life.

On the other hand, an oxide series insoluble metal electrode has a long life, the potential thereof is low as from 300 mV to 500 mV as compared with platinum and is considered to be an ideal electrode. In this case, it is necessary for the oxide series insoluble electrode coating to be uniformly coated on the entire surface of a large electrode of larger than 1 square meter for obtaining a uniform electrode potential and the potential loss due to electrical conductive resistance is reduced. Hence, increasing the thickness of the electrode base plate to reduce the electrical conductive resistance has been the practice in the past. For example, when titanium is used as an electrode base plate, a base plate having a thickness of from 25 mm to 40 mm is used.

The oxide electrode coating is formed by coating a solution of a metal capable of providing an oxide coating by thermal decomposition and thermally decomposing the metal in an oxidative atmosphere as descirbed in U.S. Pat. Nos. 3,632,498 and 3,711,385. The thermal decomposition method provides the ability to form the oxide electrode coating with a desired thickness by repeating the operation of coating the metal solution and thermally decomposing the metal. However, in this case, heating and cooling of a thick and large electrode plate must be repeatedly carried out. Hence a very long time and must labor is required for the production of the electrode.

Also, in the insoluble metal electrode, when a very small part of the electrode coating is deteriorated during the use, the metal foil or the plated product obtained becomes nonuniform. Hence, there is a problem that in such a case, not a partial treatment of the electrode coating but the regenerating treatment of the entire surface is necessary.

SUMMARY OF THE INVENTION

The present invention has solved the foregoing problems arising in conventional insoluble metal electrodes and provides an insoluble electrode structural material comprising an electrode base plate having at least one thin plate-form insoluble metal electrode detachably fixed to at least a part of the surface of the base plate and the thin plate-form insoluble metal electrodes to be fixed to the electrode base plate of the insoluble electrode structural material comprise a plurality of members each having the same form or a different form.

DETAILED DESCRIPTION OF THE INVENTION

Figure 1:
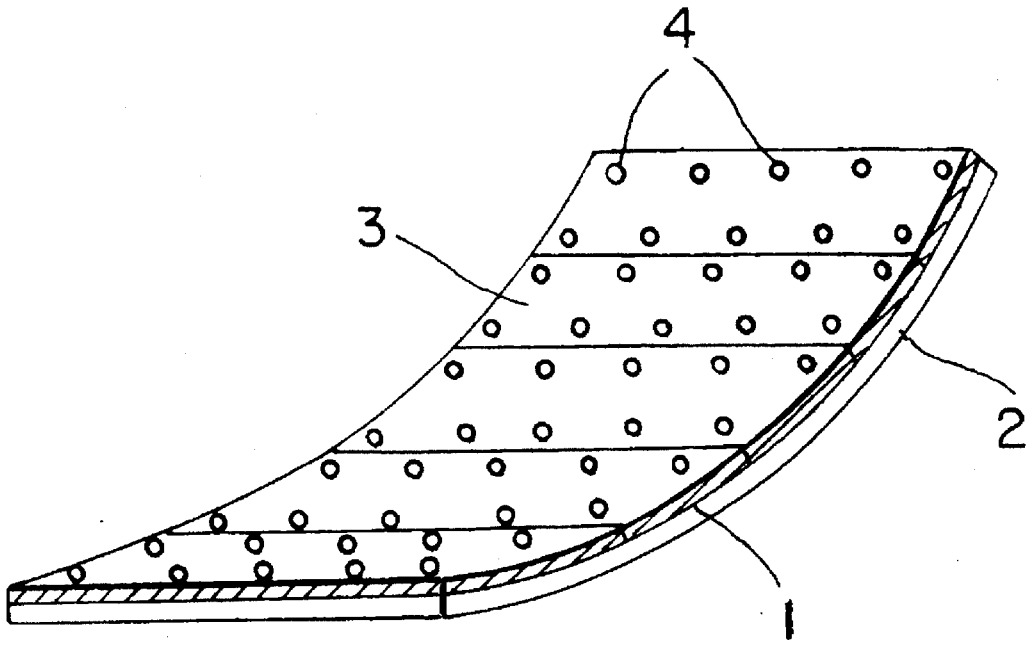
FIG. 1 is a slant view showing an example of the insoluble electrode structural material of the present invention.

The present invention is described in detail below.

In the insoluble electrode structural material of the present invention, since the thin plate-form insoluble metal electrodes are fixed to the metal base plate, the operation of forming the electrode coating by coating a metal soluton and thermally decomposing the metal becomes easy. In a conventional electrode structural material, the electrode is not only large and thick but also bosses, etc., for supplying electric current are in contact with the back surface thereof. Hence there is a problem that the temperature distribution on heating becomes non-uniform. However, in the present invention, the foregoing problem is eliminated, the treatment operation can be finished in a short time, products having a high quality can be produced in a short time, and also even when the insoluble metal electrode structural material of this invention is large and has a complicated form, the electrode structural material can be easily produced by using a plurality of standarized metal electrodes as the thin plate-form insoluble metal electrodes fixed to the electrode base plate thereof.

Furthermore, since the thin plate-form insoluble metal electrodes fixed to the surface of the elecrtode base plate of the insoluble electrode structural material of the present invention are detachably fixed to the electrode base plate by screws, etc., the insoluble metal electrodes can be fixed in a place where an electrolytic apparatus is located and the work for reactivating the insoluble metal electrode(s) when performance has deteriorated can be easily carried out in a short time by detaching the insoluble metal electrode(s) having the deteriorated performance only and reactivating the electrode(s).

FIG. 1 is a slant view showing an example of the insoluble electrode structural material of the present invention.

FIG. 1 shows an insoluble electrode structural material 1 having a size of ¼ of the circumference being used as an anode facing a cylindrical cathode of an electroytic apparatus for producing a metal foil, wherein thin plate-form insoluble metal electrodes 3 having formed thereon an electrode coating are detachably fixed to a metal base plate 2 formed by bending a thick titanium plate at the surface facing the cylindrical cathode using tapped holes formed in the metal base plate 2 and screws 4.

The form of the insoluble electrode structural material of the present invention is not limited to the above-described form but may have a size of ½ of the circumference or may be a form that thin plate-form insoluble metal electrides are fixed to a tabular metal plate.

Also, it is preferred to form an electrode coating on the surface of the metal base plate of the insoluble electrode structural material of the present invention. That is, when the insoluble electrode structural material is used as an anode, it is necessary for the electrode base plate to be formed using a rare metal such as titanium and when the electrode is anodically polarized, the electrode is not dissolved. However, when electrolyte permeates into the contact portions of the electrode base plate and the insoluble metal electrodes, the contact portions are also anodically polarized. As a result, a passive state is formed in the electrode base plate at the contact portions and a problem occurs in that passing of electric current at the contct portions becomes difficult. Thus, to prevent the occurrence of this problem at the contact portions, it becomes necessary to employ a specific structure such as a liquid proof structure for the fixed portions of the thin plate-form insoluble metal electrodes and also a method of preventing the formation of passive state by applying platinum plating to the contact portions. However, in these cases an electric current passed through the fixed portions only results in a non-uniform, electric current distribution.

On the other hand, when an electrode coating is previously formed on the surface of the electrode base plate of the insoluble electrode structural material, the elecrode base plate does not form a passive state and the electrical conductivity is not lost. Also, since thin plate-form insoluble metal electrodes are fixed onto the electrode base plate in the present invention, the electric current passing due to permeation of the electrolyte into the contact portions is small. As a result, the consumption of the elecrode coating at the contact portions is very small, the coating on the metal base plate is semipermanently effective, and the corrosion of gaps occuring at the contact surfaces with gaskets can be prevented.

Furthermore, since the entire surface of the elecrode base plate is coated with the elecrtically conductive electrode coating, passing of electric current to the thin plate-form insoluble metal electrodes is carried out not only through the fixed portions of the electrodes but also through the entire contact portions of the electrode base plate and the thin plate-form insoluble metal electrodes, which is preferable to achieve a uniform electric current distribution.

The thickness of the thin plate-form insoluble metal electrodes being fixed to the elecrode base plate of the insoluble electrode structural material of the present invention is preferably from 0.5 mm to 2 mm, and particularly preferably from 0.5 to 1.5 mm.

If the thickness is thinner than 0.5 mm, even if an electric current is passed through the entire surface of the metal base plate, the current distribution tends to become non-uniform. Also, due to the thin thickness, the flexibility is large reducing workability. Also, if the thickness is thicker than 2 mm, the work of forming the electrode coating by thermally decomposing an electrode coating material after coating the material requires a long time and the closely fixing work of the thin plate-form insoluble metal electrodes to the electrode base plate requires a long time. Hence, when the thin plate-form metal electrodes are fixed to the curved metal base plate, it becomes necessary to previously shape the thin plate-form insoluble metal electrodes in a curved form.

An optional electrode coating can be formed depending on the purpose of use of the electrode as the electrode coating formed on the thin plate-form insoluble metal electrodes in the present invention. Also, when the insoluble electrode structural material of the present invention is used as an anode for generating oxygen, it is preferred for the electrode coating to contain iridium oxide. Also, the electrode coating formed for rendering the surface of the electrode base plate electrically conductive may be different from the electrode coating being formed on the thin plate-form insoluble metal elecrodes. However, it is preferably the same as the latter coating exhibiting the same electrode potential as that of the latter coating.

Also, the insoluble electrode structural material of the present invention can be used for various kinds of electrolytic apparatus but, when it is used as an anode facing a rotary cylindrical cathode in a metal foil continuously electrolytically producing apparatus for continuously producing a metal foil by electrochemcially depositing the metal on the rotating cylindrical cathode, it is preferred to fix the thin plate-form insoluble metal electrodes to the electrode base plate having a size of ¼ or ½ of the circumference of the electrode.

Since in the present invention, thin plate-form insoluble metal electrodes are fixed to at least a part of a large tabular or curved electrode base plate by detachably fixing means such as screws, etc., thin plate-form insoluble metal electrodes having the stable characterustics of the electrode can be fixed to the electrode base plate having an optional size, whereby a large electrode structural material can be easily produced and the reactivation of the electrode coating can be easily carried out by detaching the insoluble metal electrode(s) with a lowered activity only from the electrode base plate.

The present invention is described more specifically by the following example. Unless otherwise indicated, all parts, percents, ratios and the like are by weight.

EXAMPLE 1

Tapped holes for screwing screws for fixing electrodes were formed in a semicylidrical anode base plate of a thickness of 25 mm composed of titanium. This base plate surrounded a cylindrical cathode having a diameter of 3 meters and a width of 1.5 meters for a continuous elecrolytic copper foil producing apparatus, at a width of 35 cm and at a portion corresponding to the lower portion of the cylindrical cathode.

Then, after activating the anode base plate by a conventional pre-treatment, the anode base plate was heated in air at 550° C. for 2 hours, and thereafter, the anode base plate was coated with a coating liquid prepared by dissolving iridium chloride and tantalum chloride in diluted hydrochloric acid such that the ratio of iridium to tantalum became 70:30 by weight ratio followed by heating at 490° C. for 15 minutes. By repeating the foregoing opertion 15 times, an electrode coating of a thickness of about 3 μm was formed on the surface of the anode base plate.

Apart from this, after forming tapped holes for fixing screws in a titanium plate of 1 mm in thickness covering the portion of 30 cm of the anode corresponding to the lowermost portion of the cylindrical cathode, thin plate-form insoluble metal electrodes were prepared in the same manner as described above. The time required for production was 30 hours for the semicylindrical anode base plate and 10 hours for the thin plate-form insoluble metal electrodes. The difference is mainly due to the difference in the easiness of handling and due to the difference in the heating rate and the cooling rate.

The thin plate-form insoluble metal electrodes were fixed to the anode base plate by screws. Titanium screws having an electrode coating formed on the surface were used as the screws.

In addition, the portions fixing the thin plate-form insoluble metal electrodes were less influenced by bubbles generated during electrolysis in an ordinary copper foil produc-ing apparatus and were portions that the current density became largest, i.e., the portions that the current density was increased to about 30% as compared to the minimum current density portions.

An aqueous solution containing $CuSO_4.5H_{20}$ (including 100 g/liter of copper), 150 g/liter of sulfuric acid, and 50 ppm of gelatin was used as an electrolyte. The electrolyte was supplied through a slit formed in the electrode to the space between both the electrodes at a flow rate of 60 cm/seconds, and a copper foil was continuously produced at a distance between the cathode and the anode of 10 mm and a current density of 80 $A/dm^2$. The electrolytic temperature was 60° C. and the bath potential was 4.5 volts.

As a result of the continous electolysis of about 4,000 hours, the distribution of the copper foil could not be controlled, the electrolysis was stopped, and it was found that the activity of the electrode coating at the lower portion having a high current density was lost. Since the portion was the portion fixing the thin plate-form insoluble electrode, the thin plate-form insoluble electrode was detached and exchanged with a new thin plate-form unsoluble electrode on the plate, whereby the electrolysis could be continued again.

In addition, when the thin plate-form insoluble metal electrodes were not used, the electrode coating of the electrode base plate was partially damaged, the entire electrode structural material was detached from the electrolytic apparatus and the electrode had to be reactivated.

Since in the insoluble electrode sturctural material of the present invention, thin plate-form insoluble metal electrodes are detachably fixed to a large electrode base plate, the electrode structural material having the stable characeristics of the electrode could be easily produced and the reactivation of the electrode coating could be easily carried out by detaching the inferior thin plate-form insoluble metal electrode(s) only from the electrode base plate and reactivating the electrode(s).

Also, by dividing the thin plate-form insoluble metal electrodes into a plurality of electrodes each having a standarized size, the production of the electrode structural material having an optional size and the reactivation of the insoluble metal electrode can be easily carried out. The insoluble electrode sructural material of the present invention is suitable as an anode for a high-speed plating apparatus for steel plates and a continous electrolytically metal foil producing apparatus.

While the invention has been described in detail and with reference to specific embodiments thereof, it will be apparent to one skilled in the art that various changes and modifications can be made therein without departing from the spirits and scope thereof.

What is claimed is:

1. An insoluble electrode structural material comprising a tubular or curved titanium electrode base plate having at least one thin plate insoluble metal electrode detachably fixed to at least a part of the surface of the base plate; wherein the entire surface of the electrode base plate includes an electrode coating.

* * * * *